US006685156B2

(12) United States Patent
Dicke et al.

(10) Patent No.: US 6,685,156 B2
(45) Date of Patent: Feb. 3, 2004

(54) QUICK RELEASE MECHANISM FOR USE WITH A SUPPORTING DEVICE

(75) Inventors: Grant D. Dicke, Downers Grove, IL (US); James G. Kokenes, Westmont, IL (US); Jeffrey A. Williams, Downers Grove, IL (US)

(73) Assignee: Dicke Tool Company, Downers Grove, IL (US)

( * ) Notice: Subject to any disclaimer, the term of this patent is extended or adjusted under 35 U.S.C. 154(b) by 0 days.

(21) Appl. No.: 10/145,918

(22) Filed: May 15, 2002

(65) Prior Publication Data

US 2003/0213888 A1 Nov. 20, 2003

(51) Int. Cl.[7] ..... F16M 11/38
(52) U.S. Cl. ..... 248/624; 248/166; 248/170
(58) Field of Search ..... 248/624, 160, 248/188.6, 188.7, 170, 166, 171, 173, 163.1, 165; 40/612; 403/24, 95, 327, 330, 96

(56) References Cited

U.S. PATENT DOCUMENTS 4,548,379 A 10/1985 Seely et al.
4,593,879 A 6/1986 Seely et al.
4,694,601 A 9/1987 Dicke et al.
4,699,344 A * 10/1987 Vaughan ..... 248/170
4,905,946 A * 3/1990 Wang ..... 248/170
4,954,008 A 9/1990 Dicke et al.
5,082,221 A * 1/1992 Lai ..... 248/168
5,082,222 A * 1/1992 Hsu ..... 248/170
5,102,079 A * 4/1992 Lee ..... 248/166
5,213,296 A * 5/1993 Lee ..... 248/166
5,310,145 A * 5/1994 Chen ..... 248/170
5,318,258 A * 6/1994 Lang ..... 248/166
5,340,068 A 8/1994 Sarkisian et al.
5,611,509 A * 3/1997 Kulp et al. ..... 248/188.7
6,003,827 A * 12/1999 Kulp et al. ..... 248/534
6,315,251 B1 * 11/2001 Stoudt et al. ..... 248/156
6,315,253 B1 11/2001 Dicke et al.

* cited by examiner

*Primary Examiner*—Anita King
(74) *Attorney, Agent, or Firm*—Fitch, Even, Tabin & Flannery

(57) ABSTRACT

The sign stand assembly includes a sign panel, support base and an upright mast between the two. The support base defines a locking recess and a hollow leg is pivotally connected to a plate portion and extending from the support base. The locking pin and actuator are carried within the hollow leg with the actuator carrying an outward protruding button. The actuator includes a medial portion defining an opening to receive the locking pin in interlocking engagement therewith.

14 Claims, 6 Drawing Sheets

QUICK RELEASE MECHANISM FOR USE WITH A SUPPORTING DEVICE

BACKGROUND OF THE INVENTION

1. Field of the Invention

The present invention pertains to supporting devices such as those used for temporary warning signs and in particular to such support devices which employ adjustable legs and other adjustable components.

2. Description of the Related Art

Frequently, a need arises to provide temporary warnings alongside vehicle roadways, pedestrian walkways and other locations. It has been found convenient to provide temporary warning systems which are readily assembled from a collapsed or small sized storage configuration of relatively small size. Temporary warning signs typically employ ground-engaging legs configured with a base to support an upright mast. Typically, when the sign stand is deployed, the groundengaging legs form an angle with the upright mast that is usually larger than 90°. It is generally preferred that a storage configuration be provided in which the legs are selectively collapsed or folded to a position generally parallel with the upright mast, in order to provide a compact storage and size suitable for construction vehicles and the like. Examples of leg release devices may be found in commonly assigned U.S. Pat. Nos. 4,954,008 and 6,315,253. A collapsible sign stand base for use with an upright fiberglass rib is described in U.S. Pat. No. 4,694,601 and other arrangements are shown in U.S. Pat. Nos. 4,548,379; 4,593,879 and 5,340,068. Despite the favorable acceptance of these designs, improvements are continuously being sought.

SUMMARY OF THE INVENTION

Oftentimes, ground-supporting legs are formed from hollow, rectangular tubing. If possible, it is beneficial to locate components of a leg release assembly within the tubing to prevent unintentional snagging with nearby materials. Furthermore, if most all of the leg release components can be located within the tubing, and optimally a compact storage configuration can be realized. However, until the advent of the present invention, at least some of the leg release components have been mounted outside of the legs, in order to provide a rugged construction, sufficient to adequately retain locking pins in a desired position, despite rough handling associated with construction work, as well as vibrations due to wind gusts. Substantially all of the leg release components employed by the present invention are located within the hollow tubular legs. Exceptions include only the locking pin tip and a smooth actuator button.

It is an object of the present invention to provide a release device for use with support arrangements, such as those found in sign stands.

Another object of the present invention is to provide a release device for use with support legs of collapsible sign systems.

Yet another object of the present invention is to provide leg release devices which can be economically fabricated from a minimum number of inexpensive parts.

These and other objects according to principles of the present invention are provided in a sign stand assembly which is comprises of a sign panel, a support base, an upright mast joining the sign panel and support base. This support base includes a plurality of plate portions which define a locking recess, a plurality of legs that are pivotally connecting the legs to the plate portions. A locking pin carried on one leg, for movement toward and away from the locking recess defined by one leg. An actuator that has an end within said leg for pivotally engaging the pivotal connection. An opposed end with an outwardly protruding button that partially extends outside the leg and a medial portion within the leg that defines an opening for receiving the locking pin in interlocking engagement therewith.

DETAILED DESCRIPTION OF THE PREFERRED EMBODIMENT

Figure 1:
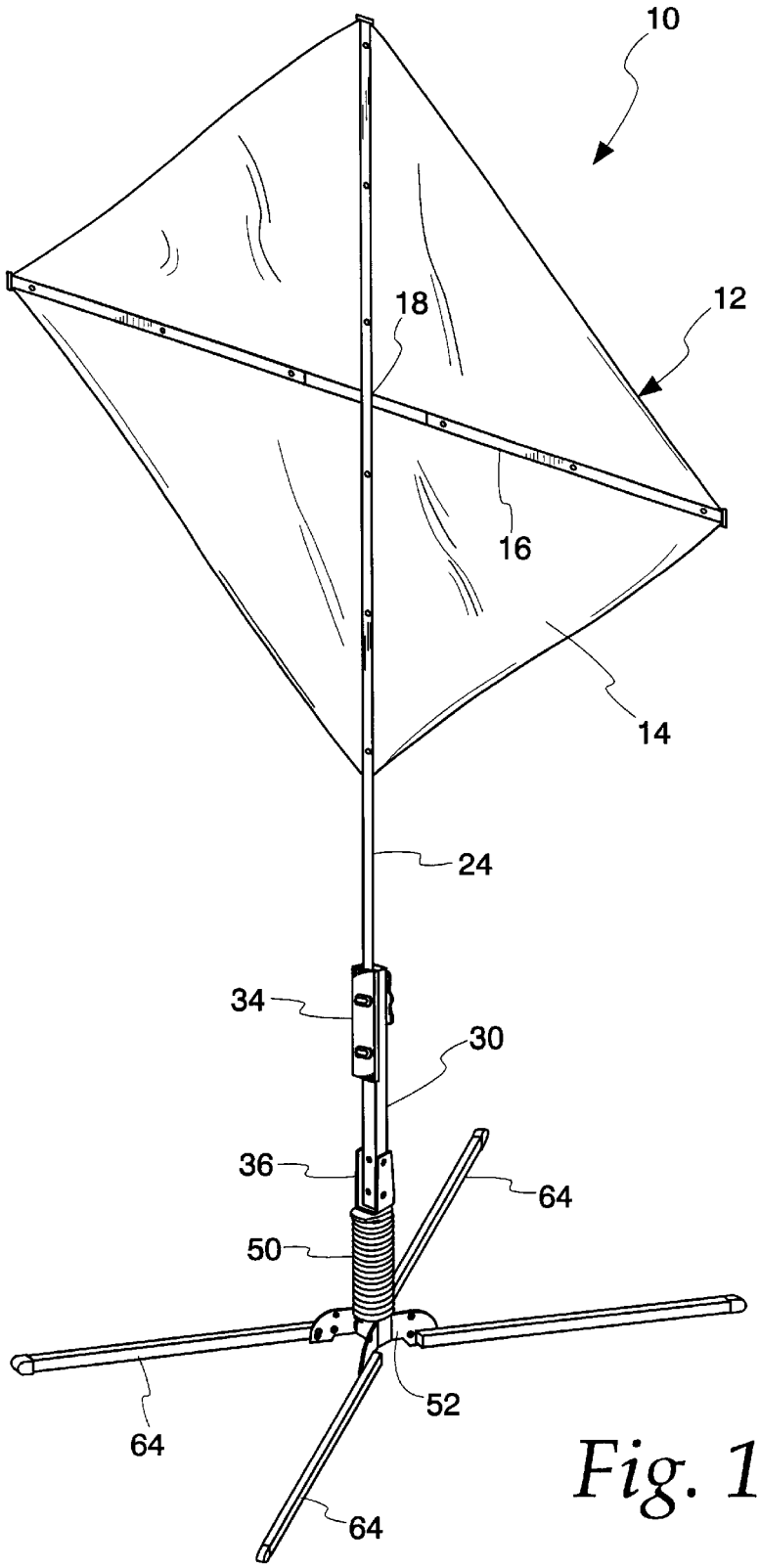
FIG. 1 is perspective view of a sign stand assembly with a release mechanism according to principles of the present invention.
Figure 2:
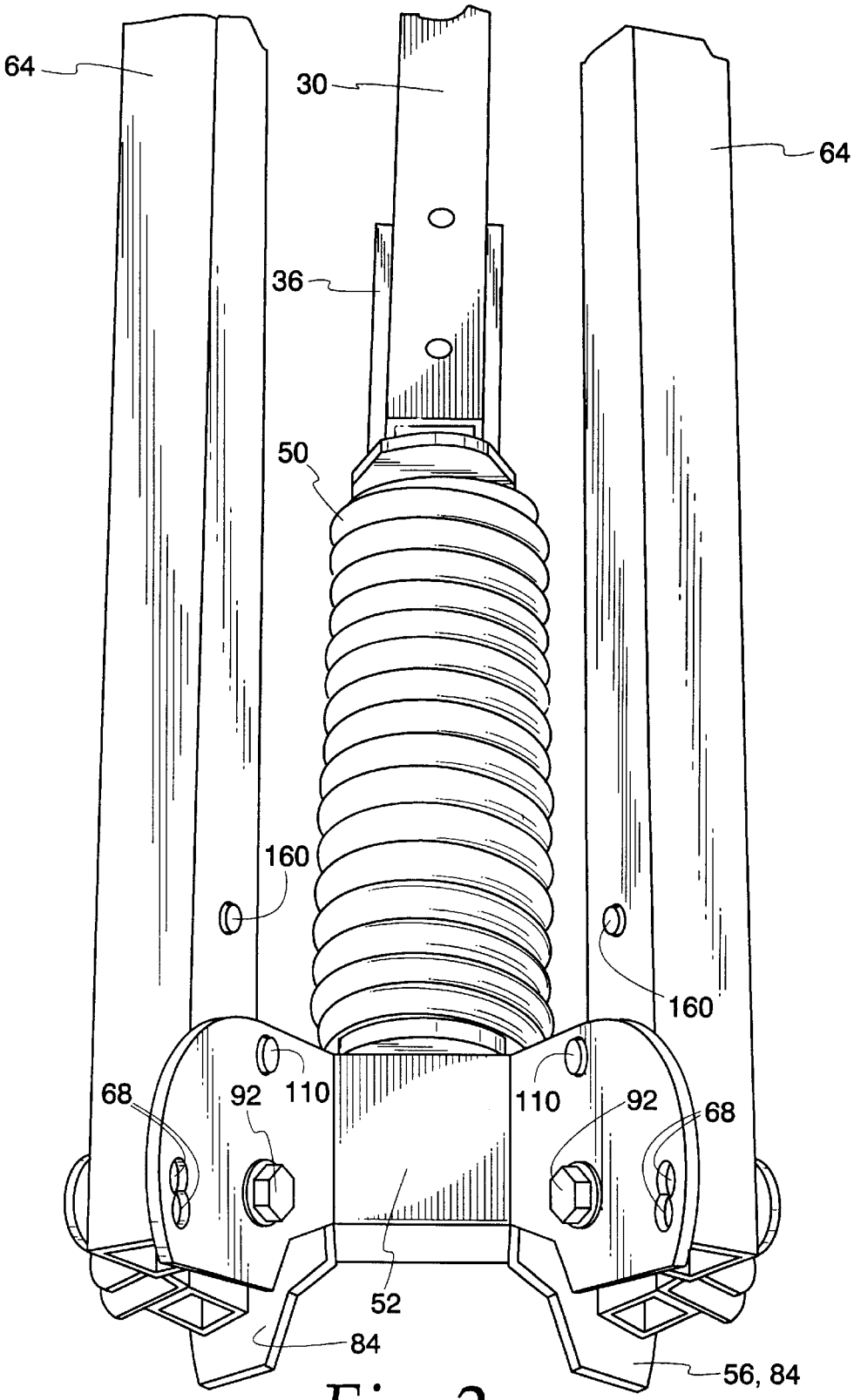
FIG. 2 is a perspective view thereof, with the sign stand assembly shown in a collapsed position.
Figure 3:
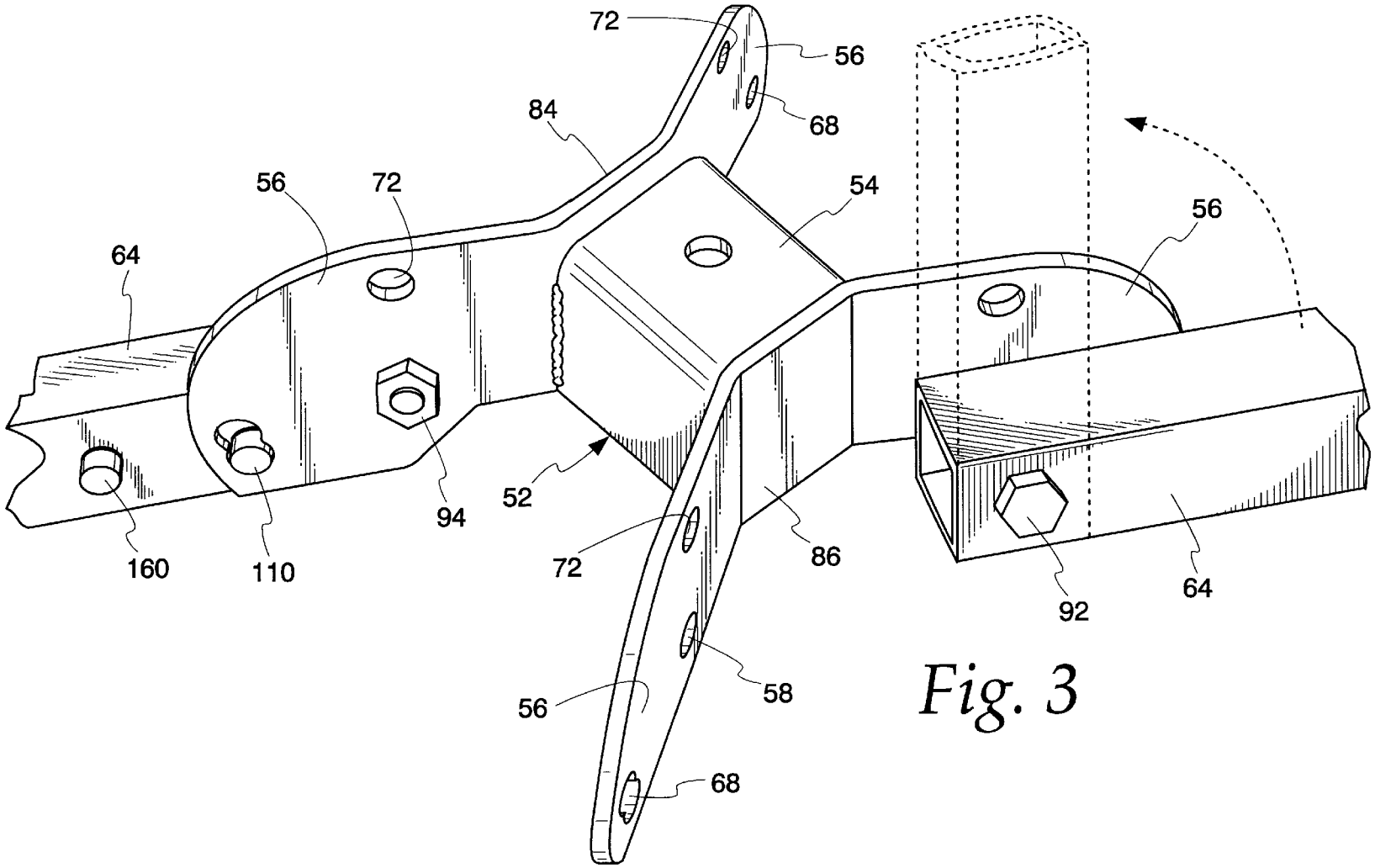
FIG. 3 is a perspective view of the support base portion thereof.

Referring now to the drawings, and initially to FIG. 1, the sign stand assembly is generally indicated at 10. Sign stand assembly includes a sign panel subassembly 12, which includes a sign panel 14 supported by a horizontal cross member 16 and a vertical cross member 18, preferably in the form of a fiberglass rib. The bottom portion 24 of the fiberglass rib is mounted in a rib clamping device 34, which is supported by a vertical body member 30. Body member 30 is in turn bolted to a bracket 36 resiliently supported by a spring 50. With reference to FIG. 3, spring 50 is supported by a support assembly 52 including a platform portion 54 supported between side plates 84. Side plates 84 include ear portions 56 having holes 58 to receive a bolt fastener which provides pivot support for ground-engaging legs 64 (see FIG. 1). Ears 56 further include holes 68 which, as will be seen herein, define an extended or operational configuration of the legs as illustrated in FIG. 1. Ear portions 56 also include holes 72 which define a collapsed storage position for the legs 64, as illustrated for example in FIG. 2.

Figure 4:
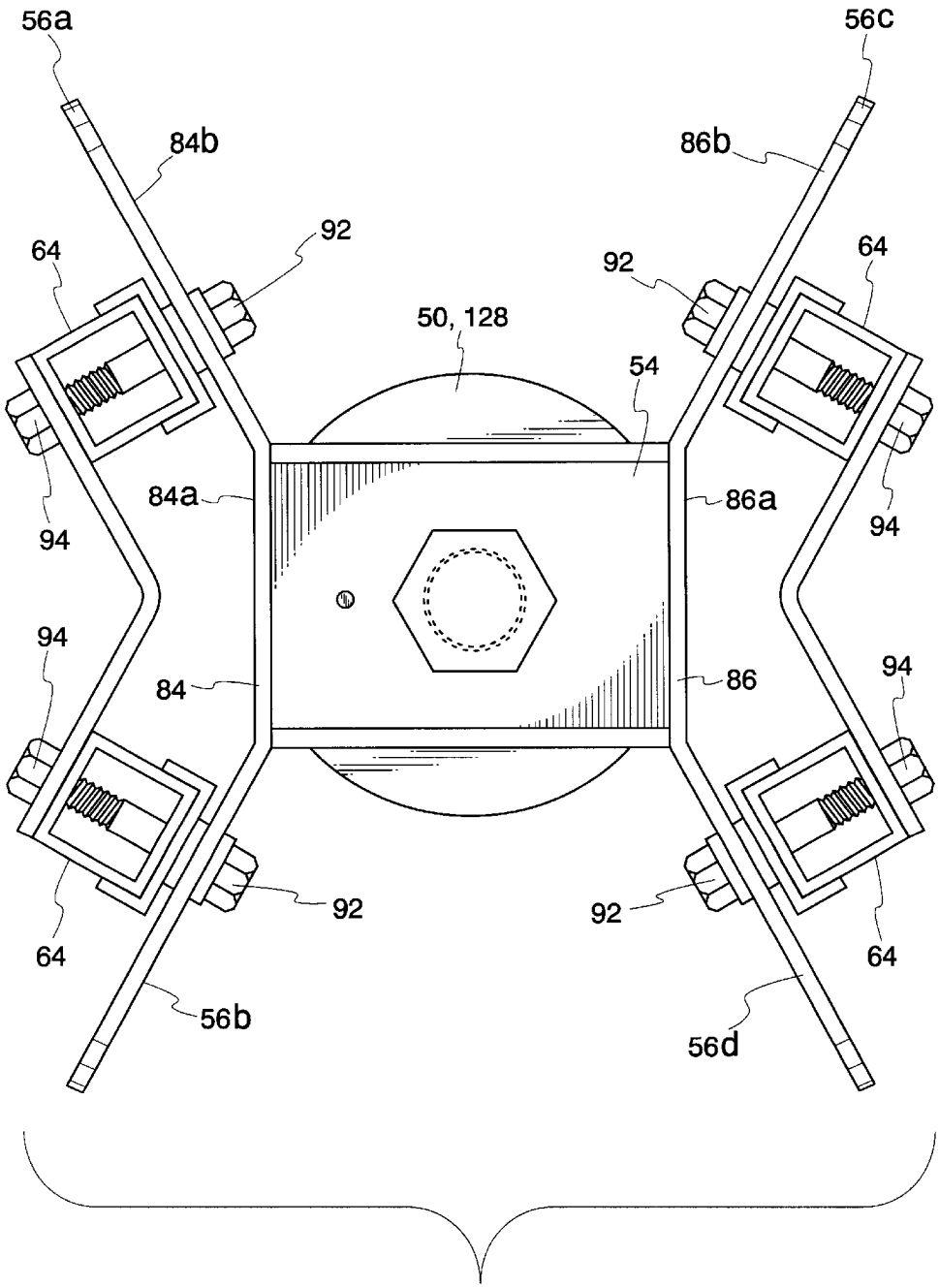
FIG. 4 is a bottom plan view of the arrangement shown in FIG. 2.

Referring to FIG. 4, ear portions 56*a*, 56*b* preferably form part of an integral side plate 84 while ear portions 56*c*, 56*d* form portions of a second side plate 86. Preferably, side plates 84, 86 are mirror images of one another although this feature is optional, and can be omitted, if desired. With further reference to FIG. 4, it can be seen that the legs 64 extend outwardly from outer surface portions 84*a*, 86*a* of side plates 84, 86. Pivot members in the form of bolt fasteners 92 pivotally connect legs 64 to the ear portions of side plates 84, 86. The legs 64 are located to one side of the ear portions with the bolt fasteners passing through the legs and ear portions. Bolt fasteners 92 have heads located adjacent the inner surfaces 84*b* and 86*b*. The bolt fasteners 92 extend through legs 64 and are terminated at their free ends by threaded nut fasteners 94. As can be seen in FIG. 4, the legs 64 comprise hollow tubing and have a preferred generally square cross-sectional shape. If desired, leg 64 can have an elongated, rectangular or non-square cross-sectional shape. With reference to FIGS. 3 and 4, bolts 92 pass through holes 58 formed in the ear portions 56 of plates 84, 86.

Figure 5:
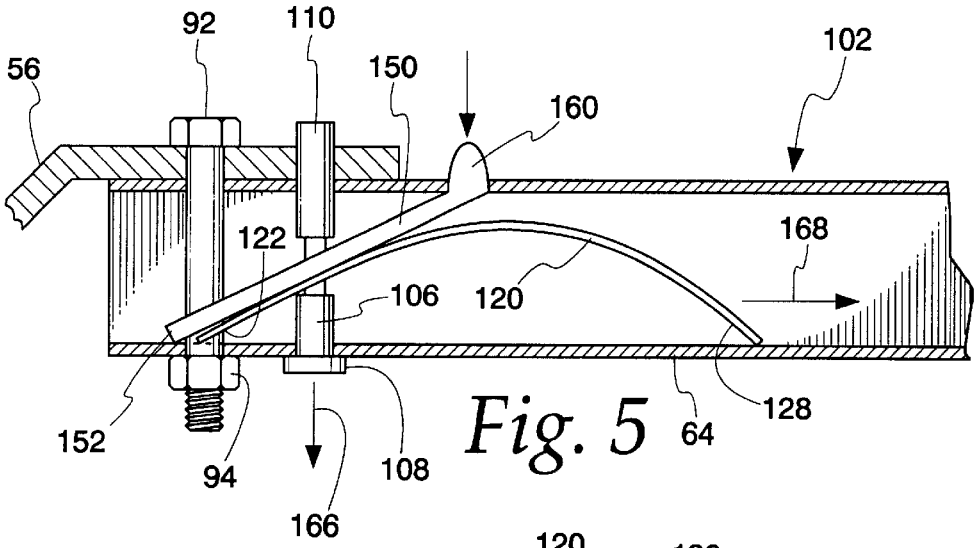
FIG. 5 is a cross-sectional view taken along the line 5—5 of FIG. 3.

With reference to FIG. 5, a release assembly is generally indicated at 102. The release assembly 102 selectively interferes with the legs 64 to lock the legs either in the operational position shown in FIG. 1 or the storage position shown in FIG. 2. As mentioned, the legs 64 pivot about bolts 92 which are secured to the inner portions of the ears 56.

With reference to FIG. 3, it can be seen that the holes 58 which receive the bolt fasteners 92 are located at inner portions of the ears 56 while the locking holes 68, 72 are located at outer portions.

Figure 10:
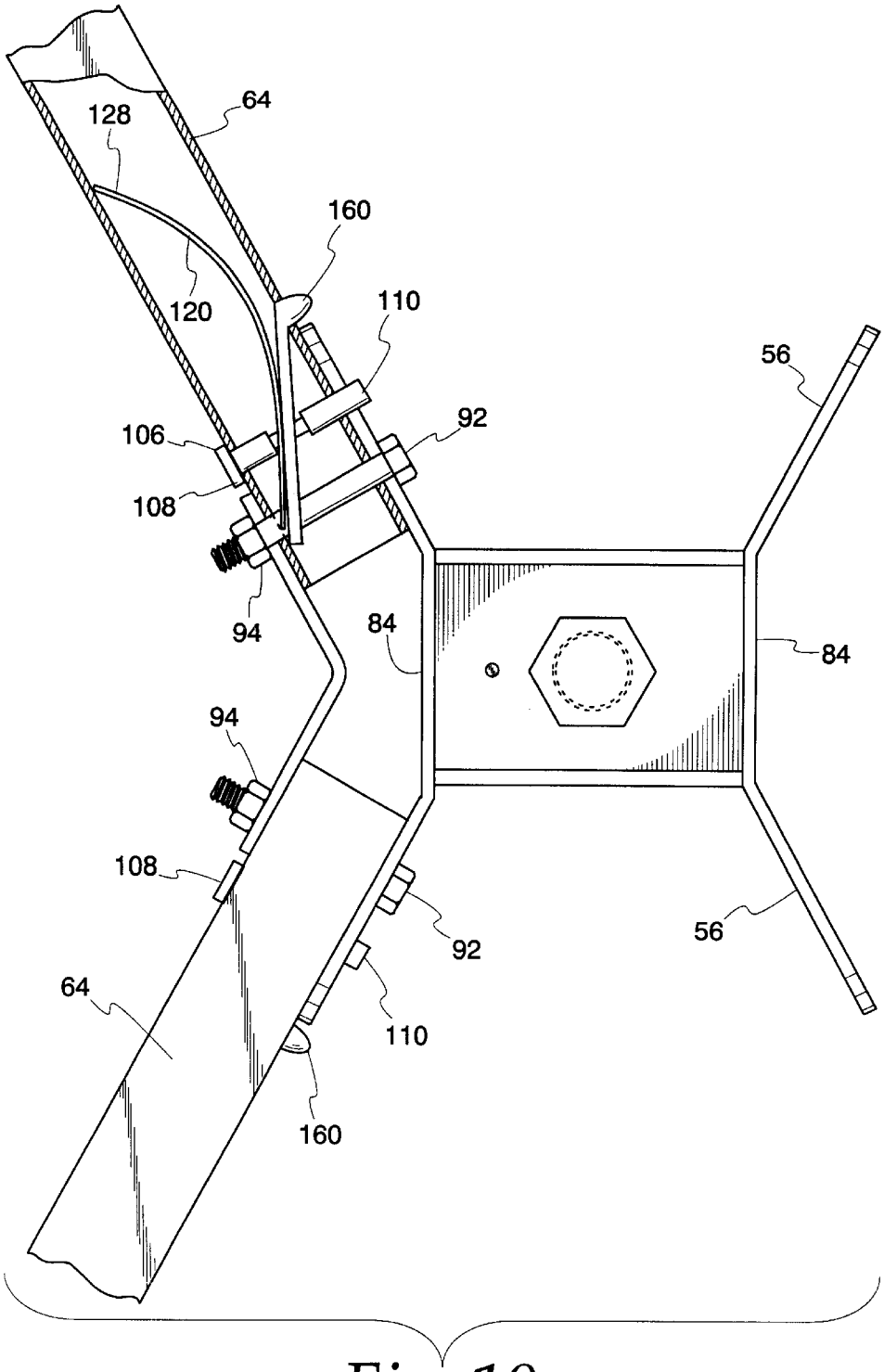
FIG. 10 is a fragmentary bottom plan view of the sign stand assembly.

Referring to FIGS. 5 and 10, release assembly 102 includes a locking pin 106 having a head 108 and a tip or free end 110. The locking pin is carried by leg 64 and preferably extends through the hollow interior of the leg. In FIG. 5, the locking pin is illustrated as extending beyond the outer surface of ear 56 for illustrative purposes. If desired, the locking pin can be configured such that the free end 110 is located at or slightly recessed below the outer surface of ear 56.

Figure 7:
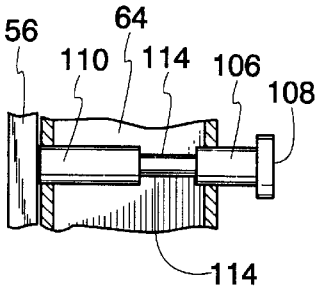
FIG. 7 is a plan view of a locking pin component thereof.

In FIG. 5, the locking pin 106 is shown in a fully extended or locked position. In the preferred embodiment, locking pin 106 has a generally cylindrical body although other cross-sectional shapes can be employed, if desired. Referring to FIG. 7, the medial portion of locking pin 106 defines a pair of opposed locking recesses 114, the bottom portions of which extend generally parallel to one another. Preferably, locking pin 106 has an elongated generally cylindrical configuration with the recesses 114 being located opposite one another on either side of the longitudinal axis. As will be seen herein, the recesses 114 are dimensioned for interlocking engagement with a keyhole-shaped opening in the actuator.

Figure 6:
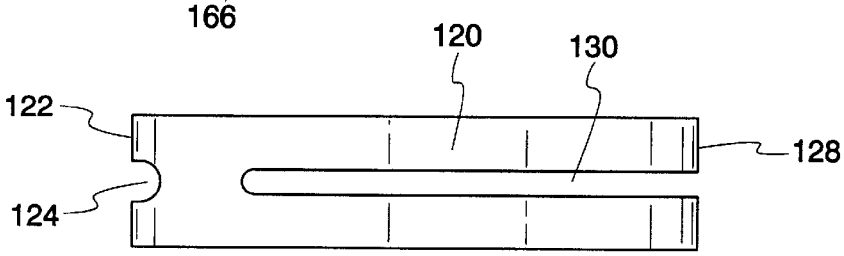
FIG. 6 is a plan view of a spring component thereof.

Referring again to FIG. 5, release assembly 102 further includes a spring member 120. The spring member 120 is preferably of a flat spring construction having first and second ends and a medial portion between the ends. The first end 122 of the spring defines a relatively shallow recess 124 giving the spring end 122 a forked or stirrup configuration. As schematically indicated in FIG. 6, recess 124 at least partially receives bolt 92. This arrangement is schematically indicated at the left-hand portion of FIG. 5 with spring end 122 engaging bolt 92 adjacent the threaded nut fastener located at the outside of leg 64.

Referring again to FIG. 6, the opposed end 128 of spring 120 defines a relatively deeper recess 130 which extends toward spring end 122. As can be seen in FIG. 6, the recesses 124, 130 are similar to one another, being located along the longitudinal center line of spring 120, but differ in their length.

With reference to FIG. 5, the free end 128 of spring 120 is free to move back and forth, toward and away from bolt 92 and locking pin 106. Recess 130 is made sufficiently long so as to permit locking pin 106 to extend through recess 130 in the manner indicated in FIG. 5.

Figure 8:
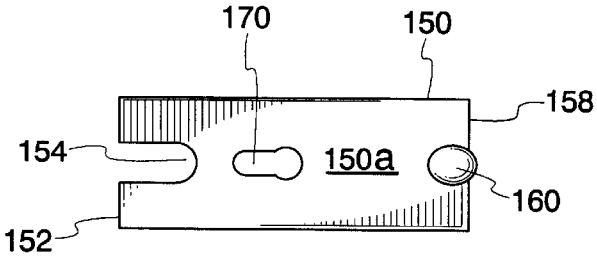
FIG. 8 is a plan view of an actuator component thereof.
Figure 9:
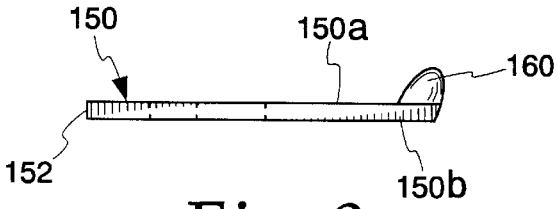
FIG. 9 is an elevational view of the actuator component.

Referring again to FIGS. 5, 8 and 9, release assembly 102 further includes an actuator 150 having a generally flat bar-like body including a first end 152 with a recess 154 for receiving bolt 92. The opposed end 158 of actuator 150 includes an upstanding button 160 having a rounded free end portion. Button 160 extends from the inside surface 150*a* of actuator 150. In the preferred embodiment, the opposed outside surface 150*b* of actuator 150 is relatively flat although outside surface 150*b* can take on a non-flat or profiled shape, if desired. The relatively flat surface preferred for the outside 150*b* of actuator 150 allows free sliding movement of spring 120 as actuator 150 is moved throughout its range of motion.

Referring again to FIG. 8, the central portion of actuator 150 defines a keyhole-shaped slot 170. The larger end of keyhole slot 170 receives the body of locking pin 106 allowing the locking pin to be inserted through the actuator to bring recesses 114 in contact with the actuator body. Recesses 1 14 cooperate with the smaller sized end of keyhole slot 170 to allow interlocking engagement between the locking pin and the actuator.

Referring again to FIG. 5, it will now be seen that the actuator 150 and spring 120 are held captive within leg 64. Button 160 extends slightly beyond the inside surface of leg 64 while the opposite end 152 engages bolt 92 preventing dislocation of actuator 150 toward the left-hand side of FIG. 5. As button 160 is depressed, locking pin 108 is moved in the direction of arrow 166, due to the interlocking of actuator 150 and pin 106. As button 160 is depressed, the outer surface of the actuator pushes against spring 120 causing the spring to compress or flatten slightly, with free end 128 of the spring moving in the direction of arrow 168. This store spring energy urging actuator 150 to return to its rest position illustrated in FIG. 5. With button 160 sufficiently depressed, the free end 110 of locking pin 106 is made to clear the plate ear portion 56, allowing the leg to be pivoted about bolt fastener 92, with the leg assuming its desired orientation.

The drawings and the foregoing descriptions are not intended to represent the only forms of the invention in regard to the details of its construction and manner of operation. Changes in form and in the proportion of parts, as well as the substitution of equivalents, are contemplated as circumstances may suggest or render expedient; and although specific terms have been employed, they are intended in a generic and descriptive sense only and not for the purposes of limitation, the scope of the invention being delineated by the following claims.

what is claimed is:

1. A sign stand assembly comprising:

a sign panel;

a support base;

an upright mast joining the sign panel and support base;

said support base including a plurality of plate portions defining a locking recess;

a plurality of legs;

pivotal connections pivotally connecting the legs to respective plate portions;

a locking pin carried on at least one of said plurality of legs, for movement toward and away from the locking recess defined by the plate portion pivotally connected to said at least one leg;

an actuator having a first end within said at least one leg for pivotally engaging said pivotal connection, an opposed end with an outwardly protruding button at least partially extending outside said at least one leg and a medial portion within said at least one leg defining an opening for receiving said locking pin in interlocking engagement therewith; and a spring disposed within said at least one leg urging said button to protrude outside said leg.

2. The sign stand assembly of claim 1 wherein said locking pin extends through said at least one leg.

3. The sign stand assembly of claim 1 wherein said locking pin has a generally cylindrical body with a longitudinal axis and a medial portion defining a pair of recesses laterally opposed with respect to said longitudinal axis.

4. The sign stand assembly according to claim 3 wherein said actuator comprises a generally flat bar.

5. The sign stand assembly according to claim 4 wherein the first end of said actuator defines a recess for receiving at least a portion of said pivotal connection.

6. The sign stand assembly according to claim 1 wherein said spring has a first end adjacent said pivotal connection, a second free end and a medial portion between said first and said second end.

7. The sign stand assembly according to claim 6 wherein the first end of said spring defines a recess of preselected depth for receiving at least a portion of said pivotal connection and the second end defines a recess having a depth greater than that of the first end, the recess of the second end receiving said locking pin and pressing against said actuator.

8. A sign stand assembly comprising:

a support base defining a locking recess, the support base providing support for the sign stand assembly;

a leg comprising a hollow rigid tube pivotally attached to said support base;

a locking pin extending through said tube for movement toward and away from the locking recess, said locking pin having an elongated, generally cylindrical body with a longitudinal axis;

an actuator having first and second ends pivotally mounted within said tube for movement between first and second positions, said actuator defining an opening intermediate its first and second ends for receiving said locking pin in interlocking engagement therewith;

a button carried on said actuator, extending from the first end of the actuator outside of the tube, said button engageable to move the actuator toward the second position; and a spring member within said tube urging the actuator to the first position thereby urging the locking pin toward the locking recess.

9. The sign stand assembly according to claim 8 wherein said locking pin has a medial portion defining a pair of opposed recesses located on either side of said longitudinal axis.

10. The sign stand assembly according to claim 8 further comprising a pivotal connection member having an elongated body pivotally attaching said leg to said support base.

11. The sign stand assembly of claim 10 wherein said actuator comprises a generally flat bar.

12. The sign stand assembly of claim 11 wherein the first end of said actuator defines a recess having a predetermined depth for at least partially receiving said pivot connection member.

13. The sign stand assembly according to claim 12 wherein said spring member comprises a flat spring having first and second ends with a medial portion between said first and second ends.

14. The sign stand assembly of claim 13 wherein the first end of said spring member defines a recess of preselected depth for receiving at least a portion of said pivot connection member and the second end of said spring member defines a recess of greater depth for receiving said locking pin.

* * * * *